US010808986B2

(12) United States Patent
Guo et al.

(10) Patent No.: US 10,808,986 B2
(45) Date of Patent: Oct. 20, 2020

(54) CONDENSER AND REFRIGERATOR HAVING SAME

(71) Applicants: HEFEI HUALING CO., LTD., Hefei (CN); MIDEA GROUP CO., LTD., Foshan (CN)

(72) Inventors: Xiaochun Guo, Hefei (CN); Pingchuan Chen, Hefei (CN); Tao Tang, Hefei (CN); Haihong Hu, Hefei (CN); Qun Huang, Hefei (CN); Xiaojun Li, Hefei (CN)

(73) Assignees: Hefei Hualing Co., Ltd., Hefei (CN); Midea Group Co., Ltd., Foshan (CN)

( * ) Notice: Subject to any disclaimer, the term of this patent is extended or adjusted under 35 U.S.C. 154(b) by 145 days.

(21) Appl. No.: 16/025,723

(22) Filed: Jul. 2, 2018

(65) Prior Publication Data

US 2018/0320951 A1 Nov. 8, 2018

Related U.S. Application Data

(63) Continuation of application No. PCT/CN2016/084157, filed on May 31, 2016.

(30) Foreign Application Priority Data

Apr. 21, 2016 (CN) ..... 2016 1 0260026

(51) Int. Cl.
*F25D 23/00* (2006.01)
*F28B 1/06* (2006.01)
(Continued)

(52) U.S. Cl.
CPC ..... *F25D 23/003* (2013.01); *F25B 39/04* (2013.01); *F25D 17/062* (2013.01); *F25D 19/00* (2013.01);
(Continued)

(58) Field of Classification Search
CPC ..... F25D 23/003; F25D 17/062; F25D 19/00; F25B 39/00; F25B 1/06; F28D 1/024;
(Continued)

(56) References Cited

U.S. PATENT DOCUMENTS 7,669,644 B2 * 3/2010 Alessandrini ..... F24H 1/43 165/162
2012/0060545 A1 * 3/2012 Rafalovich ..... F25B 39/04 62/455

FOREIGN PATENT DOCUMENTS

CN 1497234 A 5/2004
CN 101995117 A 3/2011
(Continued)

OTHER PUBLICATIONS

Hefei Hualing Co Ltd, et al., Extended European Search Report, EP16899083.6, dated Jan. 22, 2019, 6 pgs.
(Continued)

*Primary Examiner* — Elizabeth J Martin
(74) *Attorney, Agent, or Firm* — Morgan, Lewis & Bockius LLP

(57) ABSTRACT

A condenser includes an air duct defining an air channel therein; an air supply device fixedly connected to the air duct and a condensation member having a refrigerant inlet and a refrigerant outlet, the condensation member being at least partly disposed within the air channel. The condensation member includes a plurality of first condensation pipe segments consecutively arranged in multiple layers in an axial direction of the air duct and communicated with each other, each of the first condensation pipe segments is spirally formed by a first condensation pipe into a respective torus, a spiral line of said each first condensation pipe segments is located in a surface of the respective torus, and the respective torus formed in a first layer of the multiple layers is
(Continued)

stacked above the respective torus formed in a second layer of the multiple layers along the axial direction of the air duct.

15 Claims, 8 Drawing Sheets

(51) Int. Cl.

| | |
|---|---|
| ***F25D 17/06*** | (2006.01) |
| ***F28D 1/02*** | (2006.01) |
| ***F28D 7/02*** | (2006.01) |
| ***F25B 39/04*** | (2006.01) |
| ***F25D 19/00*** | (2006.01) |
| ***F28D 1/047*** | (2006.01) |
| ***F28D 21/00*** | (2006.01) |

(52) U.S. Cl.
CPC ..... *F28B 1/06* (2013.01); *F28D 1/024* (2013.01); *F28D 1/0472* (2013.01); *F28D 7/02* (2013.01); *F28D 7/024* (2013.01); *F28D 2021/007* (2013.01)

(58) Field of Classification Search
CPC .... F28D 1/0472; F28D 7/02; F28D 2021/007; F28F 1/122; F28F 1/12; F28F 1/36
See application file for complete search history.

(56) References Cited

FOREIGN PATENT DOCUMENTS

| | | | |
|---|---|---|---|
| CN | 201858909 | U | 6/2011 |
| CN | 202133219 | U | 2/2012 |
| CN | 202158706 | U | 3/2012 |
| CN | 102494469 | A | 6/2012 |
| CN | 102927745 | A | 2/2013 |
| CN | 202885359 | U | 4/2013 |
| CN | 103822410 | A | 5/2014 |
| CN | 204027382 | U | 12/2014 |
| JP | H07-270035 | A | 10/1995 |
| JP | 2012255638 | A | 12/2012 |
| KR | 100713819 | B1 | 4/2007 |
| KR | 20080101356 | A | 11/2008 |

OTHER PUBLICATIONS

Midea, International Search Report and Written Opinion, PCT/CN2016/084157, dated Jan. 20, 2017, 16 pgs.
Hefei Hualing Co. Ltd., First Office Action, CN201610260026.9, dated Mar. 24, 2020, 24 pgs.

* cited by examiner

CONDENSER AND REFRIGERATOR HAVING SAME

RELATED APPLICATIONS

This application is a continuation application of PCT Patent Application No. PCT/CN2016/084157, entitled "CONDENSER AND REFRIGERATOR HAVING SAME" filed on May 31, 2016, which claims priority to Chinese Patent Application No. 201610260026.9, filed with the Chinese Patent Office on Apr. 21, 2016, and entitled "CONDENSER AND REFRIGERATOR HAVING SAME", all of which are incorporated herein by reference in their entirety.

TECHNICAL FIELD

The present disclosure relates to a technical field of refrigeration, and specifically to a condenser and a refrigerator having the same.

BACKGROUND

Currently, a refrigeration system for a refrigerator generally uses condensers in the following two structures to perform heat dissipation.

1. A condensation pipeline is pasted to an inner wall of a refrigerator housing, and heat is transmitted and dissipated through the metal housing of the refrigerator. By adopting such a structure, the condensation pipe is attached to an inner surface of the refrigerator housing, which causes the temperature of a surface of the refrigerator to be high, resulting in an increase of temperature difference between the refrigerator housing and an inner container, increasing the speed of heat transmission from the refrigerator housing to an interior of the refrigerator, seriously influencing heat preservation property of a refrigerator body; in the meantime, in order to increase the heat dissipation effect, a length of the condensation pipe needs to be increased, thus increasing the cost.

2. A sheet condenser is fastened to a back face of the refrigerator, and the heat is dissipated by natural cooling through ambient air, so as to reach the objective of refrigeration. By adopting such a structure, the sheet condenser is fixed to the back of the refrigerator, not only the aesthetic of the refrigerator is influenced, but also the cooling efficiency is not high as the heat dissipation area of the condenser is small and the heat is dissipated only by a natural way of heat dissipation, thus influencing the product performance.

3. A sheet condenser is provided in a compressor room of the refrigerator. Since the heat dissipation area of the sheet condenser is small and a certain distance exists between an air supply device and the condenser, a dimension of the air supply device is limited by a size of a space in the compressor room, which tends to result in poor heat dissipation effect and the sheet condenser is not applicable to various kinds of refrigerators.

Therefore, a condenser with a good heat dissipation effect and a reasonable and compact arrangement is urgently needed.

SUMMARY

The present disclosure seeks to solve one of the technical problems existing in the related art to at least some extent. For that reason, the present disclosure provides a condenser, which has good heat dissipation effect and a reasonable and compact arrangement.

The present disclosure also provides a refrigerator having the condenser.

The condenser according to embodiments of a first aspect of the present disclosure includes: an air duct defining an air channel therein; an air supply device fixedly connected to the air duct; and a condensation member having a refrigerant inlet and a refrigerant outlet, the condensation member being at least partly disposed within the air channel.

The condenser according to embodiments of a first aspect of the present disclosure not only has a good heat dissipation effect, but also has a compact and reasonable arrangement, and further has better versatility.

According to some embodiments of the present disclosure, the condensation member includes a plurality of first condensation pipe segments consecutively arranged in an axial direction of the air duct and communicated with each other, each of the first condensation pipe segments is spirally formed by a first condensation pipe, and a spiral line of each of the first condensation pipe segments is located in a surface defined by a circular ring.

According to some embodiments of the present disclosure, each of the first condensation pipe segments has an inner side located in a same inner circular ring and an outer side located in a same outer circular ring, the inner circular rings of the plurality of first condensation pipe segments are arranged coaxially and the outer circular rings of the plurality of first condensation pipe segments are arranged coaxially.

According to some embodiments of the present disclosure, encircling centers of two adjacent first condensation pipe segments are coaxially provided and the encircling centers of the two adjacent first condensation pipe segments have different diameters; when the number of the first condensation pipe segments is equal to or more than two, the encircling center of each first condensation pipe segment and the encircling center of the sub-adjacent first condensation pipe segment have the same diameter.

According to some embodiments of the present disclosure, an inner diameter of the air duct is larger than a diameter of the outer circular ring.

According to some embodiments of the present disclosure, the condensation member also includes a second condensation pipe segment communicated with at least one of the plurality of first condensation pipe segments, the second condensation pipe segment being located in an inner side of the plurality of first condensation pipe segments.

According to some embodiments of the present disclosure, the second condensation pipe segment is formed by a second condensation pipe spirally encircling a center axis of the air duct.

According to some embodiments of the present disclosure, the second condensation pipe segment and the plurality of first condensation pipe segments are successively connected, the refrigerant inlet is defined in the second condensation pipe segment and the refrigerant outlet is defined in one of the plurality of first condensation pipe segments, or the refrigerant outlet is defined in the second condensation pipe segment and the refrigerant inlet is defined in one of the plurality of first condensation pipe segments.

According to some embodiments of the present disclosure, an upper end of the second condensation pipe segment is connected to the uppermost first condensation pipe segment, the first condensation pipe segment located above is connected to the adjacent first condensation pipe segment located below, the refrigerant inlet is defined in one of the second condensation pipe segment and the lowermost first condensation pipe segment, and the refrigerant outlet is defined in the other one of the second condensation pipe segment and the lowermost first condensation pipe segment.

According to some embodiments of the present disclosure, the condensation member includes a plurality of third condensation pipe segments consecutively arranged from outside to inside, two adjacent third condensation pipe segments are communicated with each other, and each of the third condensation pipe segments is formed by a third condensation pipe spirally encircling the center axis of the air duct.

According to some embodiments of the present disclosure, a spiral line of each of the third condensation pipe segments is substantially located in a same cylindrical surface, when the number of the third condensation pipe segments is equal to or more than two, a difference value between diameters of the cylindrical surfaces where the spiral lines of two adjacent third condensation pipe segments is a constant value.

According to some embodiments of the present disclosure, a spiral line of each of the third condensation pipe segments is substantially located in a same conical surface, the spiral line of each of the third condensation pipe segments gradually extends inwards from up to down, an inner diameter of the air duct is gradually reduced from up to down, and a gap is provided between the air duct and an outermost third condensation pipe segment.

According to some embodiments of the present disclosure, an inlet and an outlet of each of the third condensation pipe segments are defined at an uppermost end and at a lowermost end respectively; in two adjacent third condensation pipe segments, the inlet of one third condensation pipe segment is aligned and communicated with the outlet of the other third condensation pipe segment.

According to some embodiments of the present disclosure, the refrigerant inlet and the refrigerant outlet extend out of the air duct through a through hole located at a bottom of the air duct.

The refrigerator according to embodiments of a second aspect of the present disclosure includes the condenser.

According to an example of the present disclosure, the refrigerator has a compressor room for at least containing a compressor, and an air supply device is fixed in the compressor room through a mounting support.

Additional aspects and advantages of embodiments of present disclosure will be given in part in the following descriptions, become apparent in part from the following descriptions, or be learned from the practice of the embodiments of the present disclosure.

Figure 1:
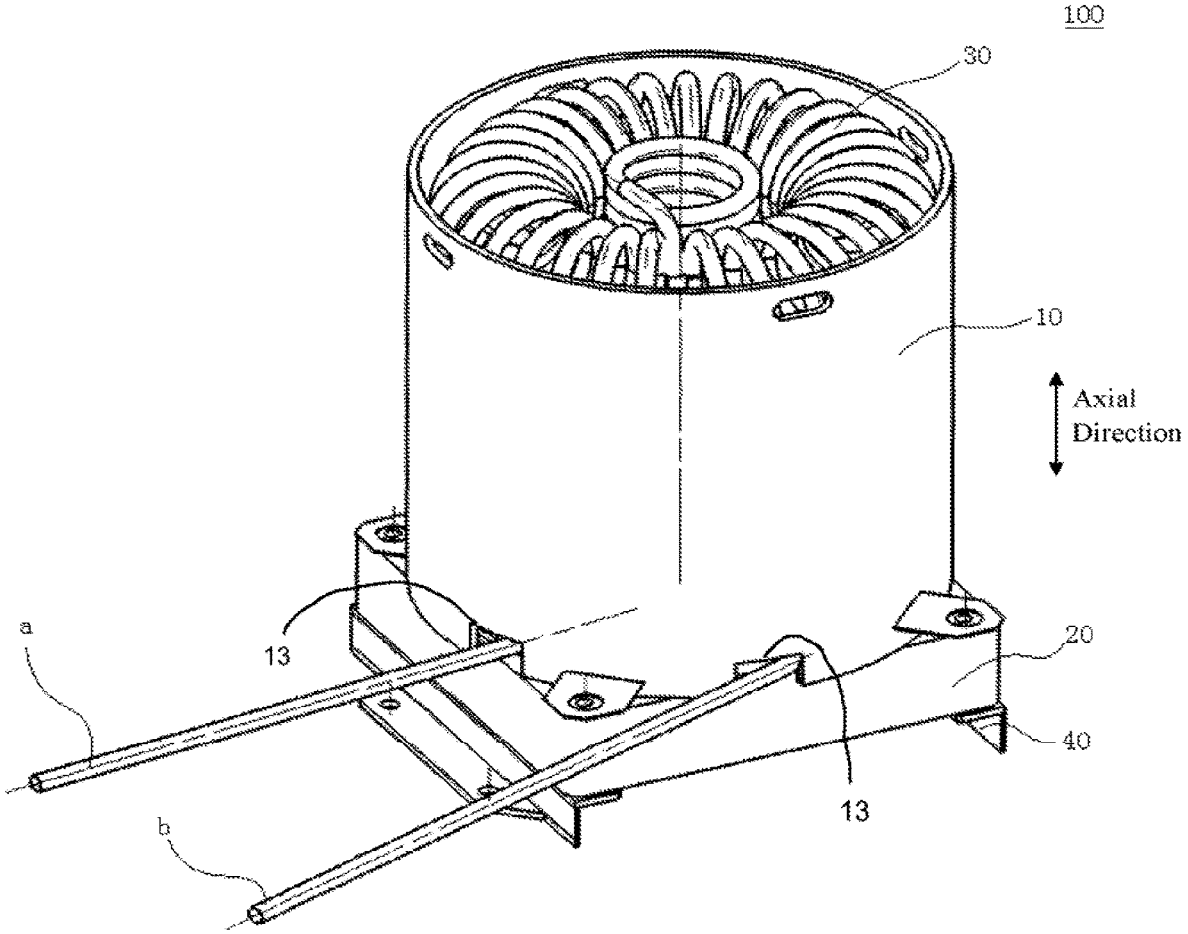
FIG. 1 is a schematic perspective view of a condenser according to an embodiment of the present disclosure.

REFERENCE NUMERALS condenser 100, air duct 10, air channel 11, bottom foot 12, mounting hole 121, through hole 13, air supply device 20, condensation member 30, refrigerant inlet a, refrigerant outlet b, first condensation pipe segment 31, inner circular ring 311, outer circular ring 312, encircling center 313, second condensation pipe segment 32, third condensation pipe segment 33, mounting support 20.

DETAILED DESCRIPTION

Embodiments of the present disclosure will be described in detail in the following, and examples of the embodiments are shown in the drawings. The same or similar elements and the elements having same or similar functions are denoted by like reference numerals throughout the descriptions. The embodiments described herein with reference to drawings are explanatory, and used to explain the present disclosure. The embodiments shall not be construed to limit the present disclosure.

A condenser 100 according to embodiments of the present disclosure will be described with reference to FIGS. 1-14 in detail in the following.

As shown in FIG. 1, the condenser 100 according to embodiments of a first aspect of the present disclosure includes an air duct 10, an air supply device 20 and a condensation member 30. The air duct 10 defines an air channel 11 therein, the air supply device 20 is fixedly connected to the air duct 10, the condensation member 30 has a refrigerant inlet a and a refrigerant outlet b, and the condensation member 30 is at least partly disposed within the air channel 11.

With the condenser 100 according to embodiments of the first aspect of the present disclosure, by integrating the air supply device 20, the air duct 10 and the refrigeration member, the air supply device 20 is used to perform forced ventilation to the air channel 11, such that ambient air can regularly enter the air channel 11 and exchange heat with the condensation member 30 in the air channel 11, thereby facilitating a quick and even heat dissipation of the condensation member 30, significantly enhancing the heat dissipation effect of the condenser 100; moreover, the overall arrangement of the condenser 100 can be more compact and reasonable and the condenser 100 can be applicable to various kinds of refrigerators.

It could be understood that, the refrigerant inlet a is used for introducing in a gas refrigerant at high temperature and high pressure. The gas refrigerant flows through the condensation member 30 and dissipates heat to the ambient air, so as to be transformed into a liquid refrigerant and flow out of the refrigerant outlet b. specifically, the air supply device 20 can be a fan, and two ends of the air duct 10 are both open, so as to allow the ambient air to enter in or flow out of the air channel 11 under the action of the air supply device 20.

Figure 2:
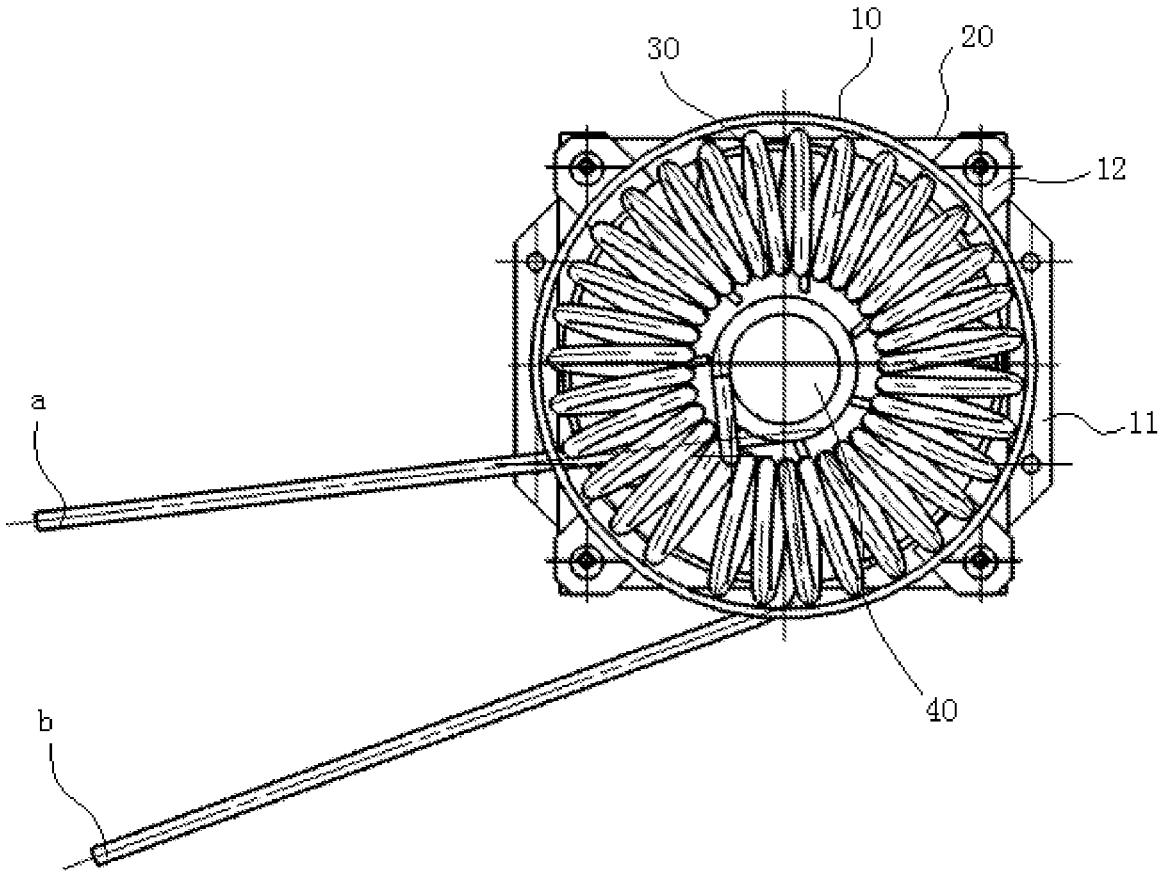
FIG. 2 is a schematic top view of a condenser according to an embodiment of the present disclosure.
Figure 3:
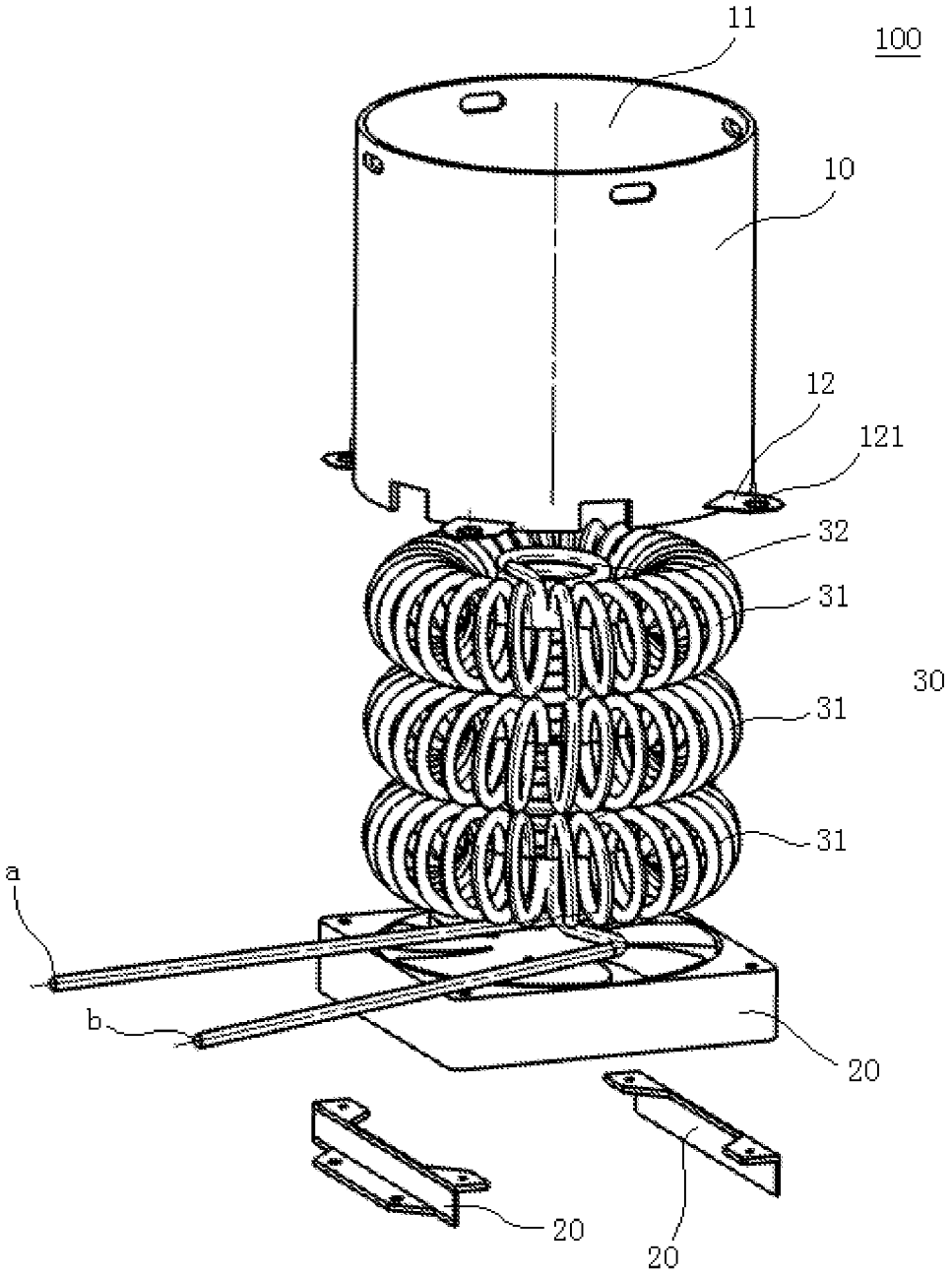
FIG. 3 is a schematic exploded view of a condenser according to an embodiment of the present disclosure.

According to some embodiments of the present disclosure, as shown in FIGS. 2 and 3, the condensation member 30 includes a plurality of first condensation pipe segments 31 consecutively arranged in an axial direction of the air duct 10 and communicated with each other. Each of the first condensation pipe segments 31 is spirally formed by a first condensation pipe, and a spiral line of each of the first condensation pipe segments 31 is located in a surface defined by a circular ring. The ring surface refers to a rotary surface formed by a circle or an ellipse completing one revolution around a straight line, in which the straight line does not intersect with the circle or ellipse. The spiral line of the first condensation pipe segment 31 is a spiral track line of the first condensation pipe.

Specifically, the ring surfaces where the plurality of first condensation pipe segments 31 is located are arranged successively in the air channel 11 from an end of the air duct 10 to the other end of the air duct 10. Each of the first condensation pipe segments 31 is communicated with at least one of the rest of the first condensation pipe segments 31, so as to allow the refrigerant to flow through each of the first condensation pipe segments 31.

Thus, the spiral line of each of the first condensation pipe segments 31 is located in the same ring surface, such that a direction of the first condensation pipe of each of the first condensation pipe segments 31 is substantially consistent with a flowing direction of airflow in the air channel 11 (the flowing direction of airflow in the air channel 11 radiates from a center of the air duct 10 to a periphery). In this way, the airflow in the air channel 11 can fully contact with each of the first condensation pipe segments 31 when flowing from the end of the air duct 10 to the other end of the air duct 10, thus increasing the heat exchange area and providing better heat dissipation effect. In addition, the plurality of first condensation pipe segments 31 are arranged layer-by-layer in the axial direction, so as to achieve a layer-by-layer heat exchange, and allow higher heat exchange efficiency.

Figure 4:
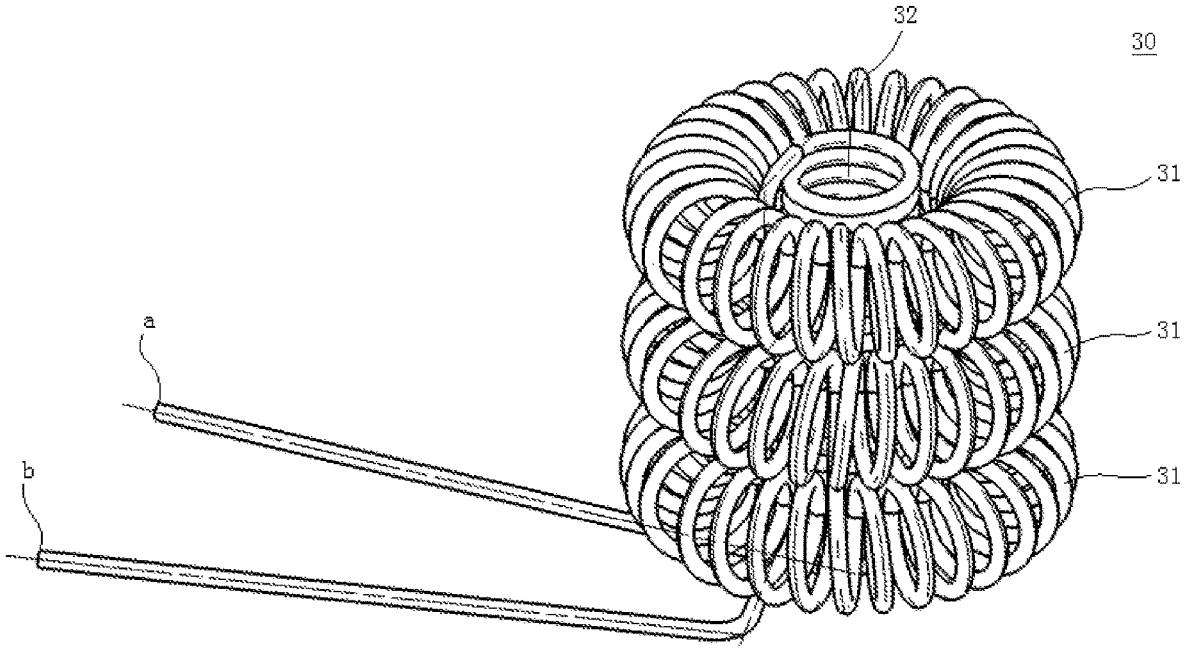
FIG. 4 is a schematic perspective view of a condensation member of a condenser according to an embodiment of the present disclosure.
Figure 5:
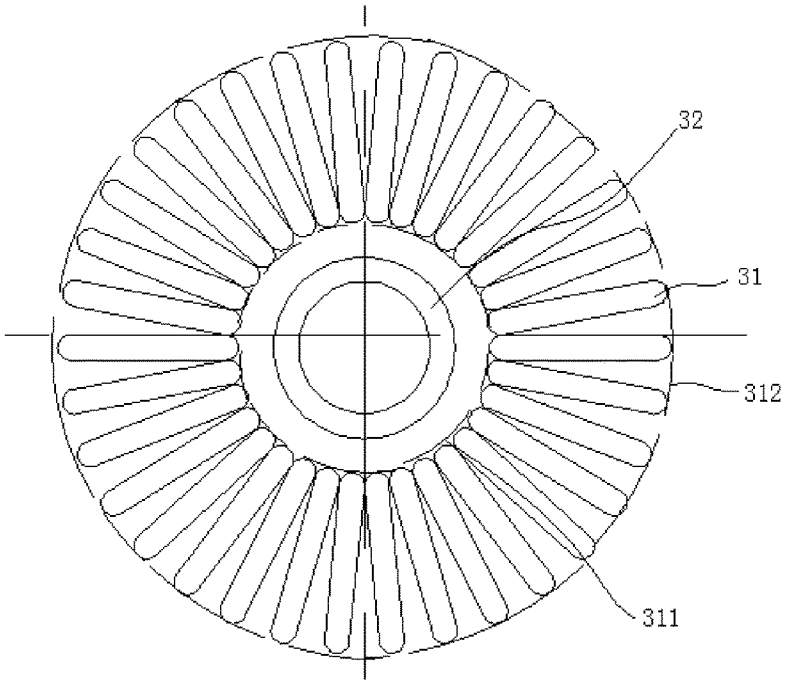
FIG. 5 is a schematic top view of a condensation member of a condenser according to an embodiment of the present disclosure.

As shown in FIGS. 4 and 5, each of the first condensation pipe segments 31 has an inner side located in a same inner circular ring 311 and an outer side located in a same outer circular ring 312. The inner circular rings 311 of the plurality of first condensation pipe segments 31 are arranged coaxially and the outer circular rings 312 of the plurality of first condensation pipe segments 31 are arranged coaxially. Thus, the airflow in the air channel 11 flows more evenly, and the heat exchange between the airflow and the first condensation pipe segments 31 is more evenly.

Figure 6:
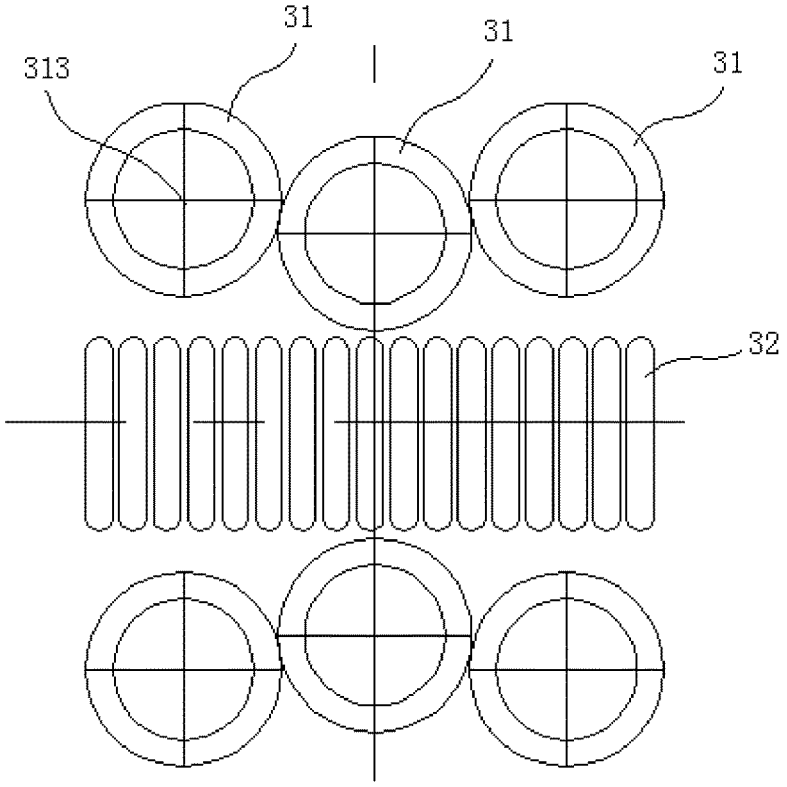
FIG. 6 is a schematic sectional view of a condensation member of a condenser according to an embodiment of the present disclosure.

As shown in FIG. 6, encircling centers 313 of two adjacent first condensation pipe segments 31 are coaxially provided and the encircling centers 313 of the two adjacent first condensation pipe segments 31 have different diameters. When the number of the first condensation pipe segments 31 is equal to or more than two, the encircling center 313 of each first condensation pipe segment 31 and the encircling center 313 of the sub-adjacent first condensation pipe segment 31 have the same diameter. The encircling center 313 of the first condensation pipe segment 31 refers to a center axis of the ring surface where the spiral line of the first condensation pipe segment 31 is located. Thus, the contact between the airflow and each of the first condensation pipe segments 31 can be more fully, and the heat exchange effect is improved.

It could be understood by those skilled in the art that, the present disclosure is not limited to this. In some other embodiments, the encircling centers 313 of the plurality of first condensation pipe segments 31 can have the same diameter.

In order to enhance the fully heat exchange between each of the first condensation pipe segments 31 and the air channel 11, an inner diameter of the air duct 10 can be larger than a diameter of the outer circular ring 312. Thus, a gap can be defined between an inner wall of the air duct 10 and each of the first condensation pipe segments 31, avoiding an un-fully heat exchange phenomenon at a contacting region due to a direct contact of the first condensation pipe segments 31 and the air duct 10 from occurring.

As a preferable embodiment, referring to FIGS. 4 and 6, the condensation member 30 also includes a second condensation pipe segment 32 communicated with at least one of the plurality of first condensation pipe segments 31, the second condensation pipe segment 32 is located at an inner side of the plurality of first condensation pipe segments 31. Specifically, the second condensation pipe segment 32 is located at an inner side of the inner circular rings 311 of the plurality of first condensation pipe segments 31. A top end of the second condensation pipe segment 32 can be flush with a top end of the first condensation pipe segment 31 which is located at the top, and a bottom end of the second condensation pipe segment 32 can be flush with a bottom end of the first condensation pipe segment 31 which is located at the bottom.

Thus, the additional second condensation pipe segment 32 reasonably makes use of a space inside each of the first condensation pipe segments 31, improving the effective heat exchange area of the condenser 100, and providing better heat dissipation effect.

In some embodiments, the second condensation pipe segment 32 is formed by a second condensation pipe spirally encircling a center axis of the air duct 10. Thus, by adopting the above-mentioned structure, the second condensation pipe segment 32 allows the airflow in the middle of the air channel 11 (the airflow in the middle of the air channel 11 substantially flows in the axial direction of the air duct 10) to contact a pipe wall of the second condensation pipe segment 32 in a substantially perpendicular direction, such that the heat dissipation effect at the second condensation pipe segment 32 is better and the heat is avoided from accumulating at the second condensation pipe segment 32.

According to some embodiments of the present disclosure, the second condensation pipe segment 32 and the plurality of first condensation pipe segments 31 are successively connected, the refrigerant inlet a is defined in the second condensation pipe segment 32 and the refrigerant outlet b is defined in one of the plurality of first condensation pipe segments 31. According to some other embodiments of the present disclosure, the second condensation pipe segment 32 and the plurality of first condensation pipe segments 31 are successively connected, the refrigerant outlet b is defined in the second condensation pipe segment 32 and the refrigerant inlet a is defined in one of the plurality of first condensation pipe segments 31.

That is, the second condensation pipe segment 32 and the plurality of first condensation pipe segments 31 are successively connected, and the refrigerant flows through each of the condensation pipe segments successively. Thus, the refrigerant unidirectionally flows in the first condensation pipe and the second condensation pipe. The condenser 100 has a better heat exchange effect.

In a specific embodiment, an upper end of the second condensation pipe segment 32 is connected to the first condensation pipe segment 31 located at the top. The first condensation pipe segment 31 located above is connected to the adjacent first condensation pipe segment 31 located below. The refrigerant inlet a is defined in one of the second condensation pipe segment 32 and the first condensation pipe segment 31 located at the bottom, and the refrigerant outlet b is defined in the other one of the second condensation pipe segment 32 and the first condensation pipe segment 31 located at the bottom. Thus, the refrigerant flows in a trend substantially from the inside to outside (or from outside to inside), thereby achieving a better heat dissipation effect.

Figure 7:
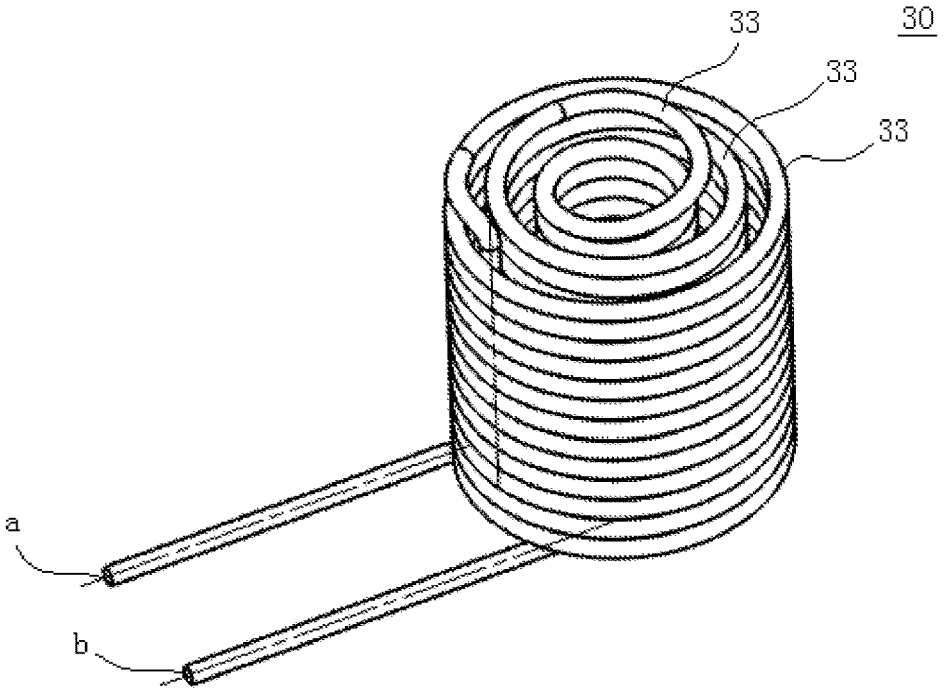
FIG. 7 is a schematic perspective view of a condensation member of a condenser according to another embodiment of the present disclosure.

It could be understood by those skilled in the art that, a curving shape of the pipeline of the condensation member 30 is not limited to the encircling shapes of the first condensation pipe segment 31 and the second condensation pipe segment 32 in the above-mentioned embodiments. For example, according to some other embodiments of the present disclosure, as shown in FIG. 7, the condensation member 30 includes a plurality of third condensation pipe segments 33 consecutively arranged from outside to inside, two adjacent third condensation pipe segments 33 are communicated with each other, and each of the third condensation pipe segments 33 is formed by a third condensation pipe spirally encircling the center axis of the air duct 10.

Figure 8:
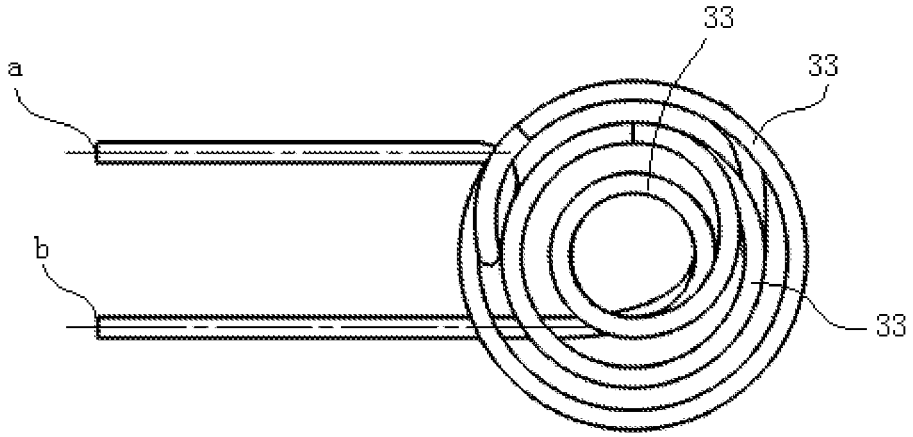
FIG. 8 is a schematic top view of a condensation member of a condenser according to another embodiment of the present disclosure.
Figure 9:
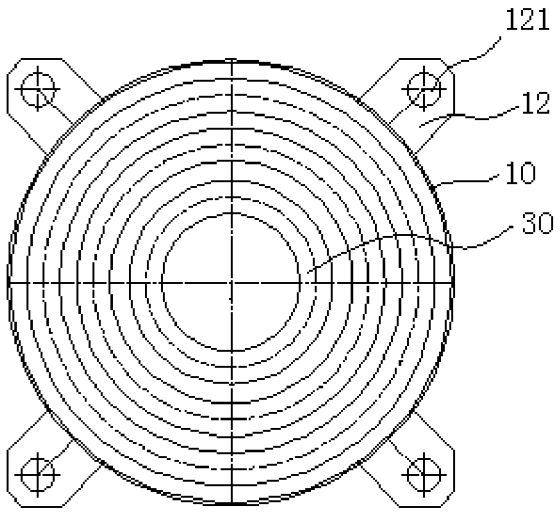
FIG. 9 is a schematic top view of a condenser according to another embodiment of the present disclosure.
Figure 10:
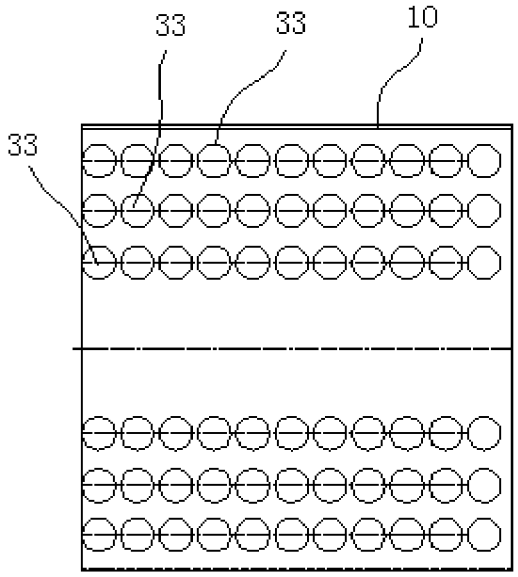
FIG. 10 is a partial sectional view of a condenser according to another embodiment of the present disclosure.

Furthermore, as shown in FIGS. 8-10, a spiral line of each of the third condensation pipe segments 33 is substantially located in a same cylindrical surface. When the number of the third condensation pipe segments 33 is equal to or more than two, a difference value between diameters of the cylindrical surfaces where the spiral lines of two adjacent third condensation pipe segments 33 are located is a constant value. Thus, the airflow in the air channel 11 can flow between the two adjacent third condensation pipe segments 33, so as to fully exchange heat with the two adjacent third condensation pipe segments 33.

It could be understood that, the spiral line of each of the third condensation pipe segments 33 can also be located in a same conical surface, the spiral line of each of the third condensation pipe segments 33 gradually extends inwards from up to down, the inner diameter of the air duct 10 is gradually reduced from up to down, and a gap is provided between the air duct 10 and an outermost third condensation pipe segment 33. Thus, the shape of the air duct 10 can provide guide for the ambient air to enter in or flow out, allowing the ambient air to enter in or flow out of the air channel 11 more quickly and smoothly, improving the heat exchange effect.

Optionally, an inlet and an outlet of each of the third condensation pipe segments 33 is defined at an uppermost end and at a lowermost end respectively. In two adjacent third condensation pipe segments 33, an inlet of one third condensation pipe segment 33 is aligned and communicated with an outlet of the other third condensation pipe segment 33. Thus, the refrigerant flows from up to down (or from down to up) in each of the third condensation pipe segments 33, and is transmitted between two adjacent third condensation pipe segments 33 from inside to outside (or from outside to inside), improving the heat exchange effect of the condenser 100.

In some embodiments, the refrigerant inlet a and the refrigerant outlet b extend out of the air duct 10 through a through hole 13 located at the bottom of the air duct 10. The refrigerant inlet a is communicated with a compressor outlet of the refrigerator, and the refrigerant outlet b is communicated with an inlet of a throttling device, thus achieving the condensation of the gas refrigerant at high temperature and high pressure in the refrigeration system.

It should be noted that, in the above-mentioned embodiment, an up-and-down direction is consistent with the axial direction of the air duct 10. An end, adjacent to the air supply device 20, of the air channel 11 (or the air duct 10) is defined as a lower end, and an end, far away from the air supply device 20, of the air channel 11 (or the air duct 10) is defined as an upper end. The airflow can be guided in from the upper end of the air duct 10 and guided out from the lower end of the air duct 10 by the air supply device 20, and can also be guided in from the lower end of the air duct 10 and guided out from the upper end of the air duct 10 by the air supply device 20.

Pipe diameter, pipe wall thickness, pipe length and pipe materials of the first to third condensation pipes each influence cooling effect and service life of the condenser 100, and can be designed according to types and specifications of the refrigerators. The pipe materials of the first to third condensation pipes can be metal (such as a copper pipe, an aluminum pipe, an iron pipe or the like), which provides good heat conductivity and pressure resistance. Inner and outer surfaces of the respective condensation pipes can be processed by electroplating and corrosion prevention.

Figure 11:
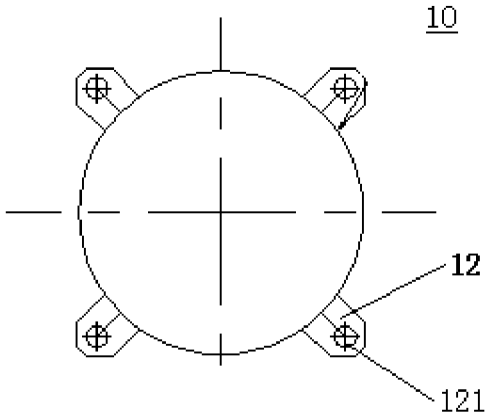
FIG. 11 is a schematic sectional view of an air duct of a condenser according to embodiments of the present disclosure.

The metal which is processed by surface anti-rust treatment can be adopted for the air duct 10 (such as a galvanized steel sheet or a stainless steel sheet), and the air duct 10 can also be a plastic molded piece which is heatproof and flame-retardant. As shown in FIG. 11, the bottom of the air duct 10 has a mounting bottom foot 12 for being connected to the fan, the mounting bottom foot 12 has a mounting hole 121, and the air supply device 20 is fixedly connected to the bottom foot 12 through a bolt.

Figure 12:
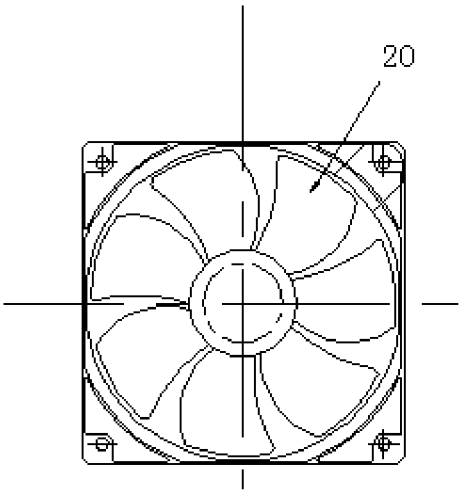
FIG. 12 is a schematic top view of an air supply device of a condenser according to embodiments of the present disclosure.
Figure 13:
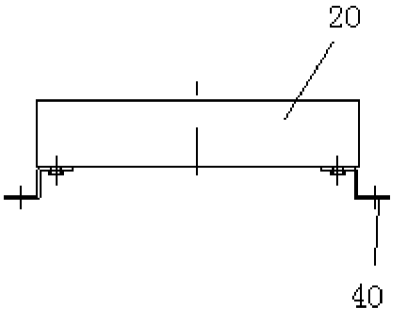
FIG. 13 is a schematic front view of an air supply device of a condenser according to embodiments of the present disclosure.
Figure 14:
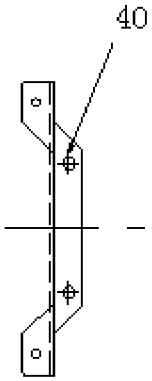
FIG. 14 is a schematic view of a mounting support of a condenser according to embodiments of the present disclosure.

As shown in FIGS. 12-14, the air supply device 20 can use a mini direct-current fan. The direct-current fan can be an induced draft fan or a suction fan, and the power and specification of the direct-current fan can be matched according to the types and specifications of the refrigerators and the dimension of the condensation pipes. The air supply device 20 is fixed to the refrigeration device through a mounting support 40.

A refrigerator according to embodiments of a second aspect of the present disclosure includes the condenser 100 of the above-mentioned embodiments. Thus, the refrigerator using the above-mentioned condenser 100 has a better refrigeration effect.

The refrigerant absorbs the heat inside the refrigerator body in an evaporator of the refrigerator, becomes steam at high temperature and high pressure under the compression of the compressor, and the steam is sent to the condenser 100. The condenser 100 dissipates heat to the ambient air and condenses the steam at high temperature and high pressure into liquid refrigerant, which is throttled through the throttling device and is sent into the evaporator. The refrigerant in the evaporator boils and evaporates violently due to the reduced pressure, and absorbs the heat of the cooled object in the refrigerator body, thereby generating the refrigeration effect. The refrigerant steam is sent to the compressor again, and the circulation repeats in such way.

In some embodiments, the refrigerator has a compressor room for at least containing the compressor, and the air supply device 20 is fixed in the compressor room through the mounting support 40. Thus, the space in the compressor room is reasonably used, and when the complete machine operates, the highly effective heat exchange between the refrigerant and the ambient environment is achieved, thereby improving the refrigeration efficiency.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from the scope of the present disclosure.

What is claimed is:

1. A condenser comprising:

an air duct defining an air channel therein;

an air supply device fixedly connected to the air duct; and a condensation member having a refrigerant inlet and a refrigerant outlet, the condensation member being at least partly disposed within the air channel, wherein the condensation member comprises a plurality of first condensation pipe segments consecutively arranged in multiple layers in an axial direction of the air duct and communicated with each other, each of the first condensation pipe segments is spirally formed by a first condensation pipe into a respective torus, a spiral line of said each first condensation pipe segments is located in a surface of the respective torus, and the respective torus formed in a first layer of the multiple layers is stacked above the respective torus formed in a second layer of the multiple layers along the axial direction of the air duct.

2. The condenser according to claim 1, wherein each of the first condensation pipe segments has an inner side located in a same inner circular ring and an outer side located in a same outer circular ring, the inner circular rings of the plurality of first condensation pipe segments are arranged coaxially and the outer circular rings of the plurality of first condensation pipe segments are arranged coaxially.

3. The condenser according to claim 1, wherein encircling centers of two adjacent first condensation pipe segments are coaxially provided and the encircling centers of the two adjacent first condensation pipe segments have different diameters; when the number of the first condensation pipe segments is equal to or more than two, the encircling center of each first condensation pipe segment and the encircling center of the sub-adjacent first condensation pipe segment have the same diameter.

4. The condenser according to claim 1, wherein an inner diameter of the air duct is larger than a diameter of the outer circular ring.

5. The condenser according to claim 1, wherein the condensation member also comprises a second condensation pipe segment communicated with at least one of the plurality of first condensation pipe segments, the second condensation pipe segment being located in an inner side of the plurality of first condensation pipe segments.

6. The condenser according to claim 5, wherein the second condensation pipe segment is formed by a second condensation pipe spirally encircling a center axis of the air duct.

7. The condenser according to claim 6, wherein the second condensation pipe segment and the plurality of first condensation pipe segments are successively connected, the refrigerant inlet is defined in the second condensation pipe segment and the refrigerant outlet is defined in one of the plurality of first condensation pipe segments, or the refrigerant outlet is defined in the second condensation pipe segment and the refrigerant inlet is defined in one of the plurality of first condensation pipe segments.

8. The condenser according to claim 7, wherein an upper end of the second condensation pipe segment is connected to the uppermost first condensation pipe segment, the first condensation pipe segment located above is connected to the adjacent first condensation pipe segment located below, the refrigerant inlet is defined in one of the second condensation pipe segment and the lowermost first condensation pipe segment located, and the refrigerant outlet is defined in the other one of the second condensation pipe segment and the lowermost first condensation pipe segment.

9. The condenser according to claim 1, wherein the refrigerant inlet and the refrigerant outlet extend out of the air duct through holes located at a bottom of the air duct.

10. A condenser comprising:

an air duct defining an air channel therein;

an air supply device fixedly connected to the air duct; and a condensation member having a refrigerant inlet and a refrigerant outlet, the condensation member being at least partly disposed within the air channel, wherein the condensation member comprises a plurality of third condensation pipe segments consecutively arranged in multiple layers in an axial direction of the air duct from outside to inside, two adjacent third condensation pipe segments are communicated with each other, and each of the third condensation pipe segments is formed by a third condensation pipe spirally encircling a center axis of the air duct, and a respective spiral formed in a first layer of the multiple layers is stacked above the respective spiral formed in a second layer of the multiple layers along the axial direction of the air duct.

11. The condenser according to claim 10, wherein a spiral line of each of the third condensation pipe segments is substantially located in a same cylindrical surface, when the number of the third condensation pipe segments is equal to or more than two, a difference value between diameters of the cylindrical surfaces where the spiral lines of two adjacent third condensation pipe segments is a constant value.

12. The condenser according to claim 10, wherein a spiral line of each of the third condensation pipe segments is substantially located in a same conical surface, the spiral line of each of the third condensation pipe segments gradually extends inwards from up to down, an inner diameter of the air duct is gradually reduced from up to down, and a gap is provided between the air duct and an outermost third condensation pipe segment.

13. The condenser according to claim 10, wherein an inlet and an outlet of each of the third condensation pipe segments are defined at an uppermost end and at a lowermost end respectively; in two adjacent third condensation pipe segments, the inlet of one third condensation pipe segment is aligned and communicated with the outlet of the other third condensation pipe segment.

14. A refrigerator, comprising a condenser, the condenser further comprising:

an air duct defining an air channel therein;

an air supply device fixedly connected to the air duct; and a condensation member having a refrigerant inlet and a refrigerant outlet, the condensation member being at least partly disposed within the air channel, wherein the condensation member comprises a plurality of first condensation pipe segments consecutively arranged in multiple layers in an axial direction of the air duct and communicated with each other, each of the first condensation pipe segments is spirally formed by a first condensation pipe into a respective torus, a spiral line of said each first condensation pipe segments is located in a surface of the respective torus, and the respective torus formed in a first layer of the multiple layers is stacked above the respective torus formed in a second layer of the multiple layers along the axial direction of the air duct.

15. The refrigerator according to claim 14, wherein the refrigerator has a compressor room for at least containing a compressor, and an air supply device is fixed in the compressor room through a mounting support.

* * * * *